US006755352B1

(12) United States Patent
Toda

(10) Patent No.: US 6,755,352 B1
(45) Date of Patent: Jun. 29, 2004

(54) BRIDGE-TYPE ULTRASONIC ATOMIZER

(76) Inventor: Kohji Toda, 1-49-18 Futaba, Yokosuka (JP), 239-0814

( * ) Notice: Subject to any disclaimer, the term of this patent is extended or adjusted under 35 U.S.C. 154(b) by 0 days.

(21) Appl. No.: 10/350,950

(22) Filed: Jan. 22, 2003

(51) Int. Cl.[7] ..... B65B 1/08
(52) U.S. Cl. ..... 239/102.1; 239/102.2
(58) Field of Search ..... 239/102.1, 102.2

(56) References Cited

U.S. PATENT DOCUMENTS 5,657,926 A * 8/1997 Toda ..... 239/102.2
5,852,261 A * 12/1998 Toda ..... 178/18.04
5,996,902 A * 12/1999 Morimoto et al. ..... 239/4
6,293,474 B1 * 9/2001 Helf et al. ..... 239/102.2
6,297,525 B1 * 10/2001 Parekh et al. ..... 257/306
6,685,302 B2 * 2/2004 Haluzak et al. ..... 347/54

* cited by examiner

*Primary Examiner*—Hoang Nguyen

(57) ABSTRACT

A bridge-type ultrasonic atomizer comprises input- and output piezoelectric substrates, first- and second electrodes formed on the input piezoelectric substrate, third- and fourth electrodes formed on the output piezoelectric substrate, a porous nonmetalic-plate formed between the input- and output piezoelectric substrates. When an input electric signal is applied between the first- and second electrodes, a first acoustic vibration is excited in the input piezoelectric substrate. The first acoustic vibration makes a liquid in the porous nonmetalic-plate to be atomized, at the same time, causes a second acoustic vibration in the output piezoelectric substrate only when the liquid exists in the porous nonmetalic-plate. The second acoustic vibration is detected as a delayed electric signal between the third- and fourth electrodes, and is fed back to the first- and second electrodes again. As a result, the porous nonmetalic-plate prevents the operation without liquid.

20 Claims, 9 Drawing Sheets

BRIDGE-TYPE ULTRASONIC ATOMIZER

BACKGROUND OF THE INVENTION

1. Field of the Invention

The present invention relates to a bridge-type ultrasonic atomizer by means of using at least one piezoelectric substrate and a porous nonmetalic-plate.

2. Description of the Prior Art

Conventional ultrasonic atomizer such as a nebulizer-type atomizer has difficulties in miniaturizing device size, and making electric power consumption down. The ultrasonic vibrating device presented by Toda in U.S. Pat. No. 5,297,734, realized high atomization efficiency and high ability for atomizing minute and uniform particles. In addition, Toda (U.S. Pat. No. 5,297,734) made device size miniaturize. However, Toda (U.S. Pat. No. 5,297,734) failed in making operation voltage down, and making circuit construction simple, and had no way to conquer the resonance frequency deviation affected by the temperature change, that is, failed in continuous-stable atomization. A way to conquer the resonance frequency deviation affected by the temperature change is disclosed in the ultrasonic atomizing device presented by Toda in U.S. Pat. No. 5,657,926. Toda (U.S. Pat. No. 5,657,926) realized continuous-stable atomization under low voltage with low electric power consumption. However, Toda (U.S. Pat. No. 5,657,926) failed in producing standardized articles in the process of manufacturing, because a cementing condition of a vibrating plate 2 to a piezoelectric vibrator 1 (Toda, U.S. Pat. No. 5,657,926, FIG. 1) makes a change in length of the assembly composed of the piezoelectric vibrator 1 and the vibrating plate 2. The change in length of the assembly causes a change in operation frequency. A lack of unity of the operation frequency is undesirable for circuit construction.

This application is an improvement on the Toda application (U.S. Pat. No. 5,657,926).

SUMMARY OF THE INVENTION

An object of the present invention is to provide a bridge-type ultrasonic atomizer capable of atomizing under low voltage with low electric power consumption.

Another object of the present invention is to provide a bridge-type ultrasonic atomizer capable of atomizing minute and uniform particles.

Another object of the present invention is to provide a bridge-type ultrasonic atomizer capable of conquering the resonance frequency deviation affected by the temperature change.

Another object of the present invention is to provide a bridge-type ultrasonic atomizer capable of continuous-stable atomization.

Another object of the present invention is to provide a bridge-type ultrasonic atomizer having a small size and a simple structure, which is very light in weight.

A still other object of the present invention is to provide a bridge-type ultrasonic atomizer capable of producing standardized articles in the process of manufacturing.

A still further object of the present invention is to provide a bridge-type ultrasonic atomizer capable of preventing the operation without liquid.

According to one aspect of the present invention there is provided a bridge-type ultrasonic atomizer comprising an input piezoelectric substrate with a pillar body having two end surfaces orthogonal to the thickness direction thereof, first- and second electrodes formed on one and the other end surfaces, respectively, of the input piezoelectric substrate, third- and fourth electrodes formed on one and the other end surfaces, respectively, of the output piezoelectric substrate, a porous nonmetalic-plate formed as a bridge between the input- and output piezoelectric substrates, and an amplifier.

When an input electric signal is applied between the first- and second electrodes, a first acoustic vibration is excited in the input piezoelectric substrate. The first acoustic vibration propagates in the porous nonmetalic-plate. In this time, if a liquid exists in pierced pores of the porous nonmetalic-plate, the liquid is atomized toward the outside. The first acoustic vibration also causes a second acoustic vibration in the output piezoelectric substrate only when the liquid exists in the pierced pores. The second acoustic vibration is detected as a delayed electric signal between the third- and fourth electrodes. The delayed electric signal is amplified via the amplifier, and an amplified electric signal is fed as the input electric signal back to the first- and second electrodes again.

According to another aspect of the present invention there is provided a bridge-type ultrasonic atomizer, wherein the input electric signal has a frequency approximately equal to the resonance frequency in the combination of the input- and output piezoelectric substrates.

According to another aspect of the present invention there is provided a bridge-type ultrasonic atomizer, wherein the input electric signal has a frequency approximately equal to the resonance frequency in the input piezoelectric substrate alone.

According to another aspect of the present invention there is provided a porous nonmetalic-plate having a specific gravity smaller than the input- and output piezoelectric substrates, respectively.

According to another aspect of the present invention there is provided a porous nonmetalic-plate made of a rigid polymer plate.

According to another aspect of the present invention there is provided a porous nonmetalic-plate made of a silicone wafer.

According to another aspect of the present invention there is provided an input piezoelectric substrate having two end surfaces, of which each has an oblong shape. In this arrangement, the porous nonmetalic-plate is cemented with an edge on the second electrode and that on the fourth electrode.

According to another aspect of the present invention there is provided an input piezoelectric substrate having two end surfaces, of which each has a square shape. In this arrangement, the porous nonmetalic-plate is cemented with an edge on the second electrode and that on the fourth electrode.

According to another aspect of the present invention there are provided input- and output piezoelectric substrates, of which each is made of a piezoelectric ceramic and has a polarization axis parallel to the thickness direction thereof.

According to another aspect of the present invention there is provided a liquid provider with a liquid-absorption material, which provides the porous nonmetalic-plate with a liquid.

According to another aspect of the present invention there is provided a bridge-type ultrasonic atomizer comprising a piezoelectric substrate with a pillar body having two end surfaces orthogonal to the thickness direction thereof; first- and second electrodes formed on one and the other end surfaces, respectively, of the piezoelectric substrate, a vibration reflector, and a porous nonmetalic-plate formed as a bridge between the piezoelectric substrate and the vibration reflector.

When an input electric signal having a frequency approximately equal to the resonance frequency in the piezoelectric substrate alone is applied between the first- and second electrodes, an acoustic vibration is excited in the piezoelectric substrate. The acoustic vibration propagates in the porous nonmetalic-plate. In this time, if a liquid exists in pierced pores of the porous nonmetalic-plate, the liquid is atomized toward the outside. On the other hand, the acoustic vibration is reflected at the vibration reflector back to the porous nonmetalic-plate.

According to other aspect of the present invention there is provided a piezoelectric substrate made of a piezoelectric polymer.

According to a further aspect of the present invention there is provided a bridge-type ultrasonic atomizer comprising a piezoelectric substrate with a pillar body having two end surfaces orthogonal to the thickness direction thereof, first- and second electrodes formed on one and the other end surfaces, respectively, of the piezoelectric substrate, a vibration reflector, and a porous nonmetalic-plate formed as a bridge between the piezoelectric substrate and the vibration reflector. The second electrode consists of two electrically separated electrodes.

When an input electric signal having a frequency approximately equal to the resonance frequency in the piezoelectric substrate alone is applied between the first electrode and one of the electrically separated electrodes, an acoustic vibration is excited in the piezoelectric substrate. The acoustic vibration propagates in the porous nonmetalic-plate. In this time, if a liquid exists in pierced pores of the porous nonmetalic-plate, the liquid is atomized toward the outside. On the other hand, the acoustic vibration is reflected at the vibration reflector back to the porous nonmetalic-plate. The acoustic vibration in the piezoelectric substrate also causes a delayed electric signal between the first electrode and the other of the electrically separated electrodes. The delayed electric signal is fed as the input electric signal back to the first electrode and the one of the electrically separated electrodes again.

BRIEF DESCRIPTION OF THE DRAWINGS

Other features and advantages of the invention will be clarified from the following description with reference to the attached drawings.

DETAILED DESCRIPTION OF THE PRESENTLY PREFERRED EXEMPLARY EMBODIMENTS

Figure 1:
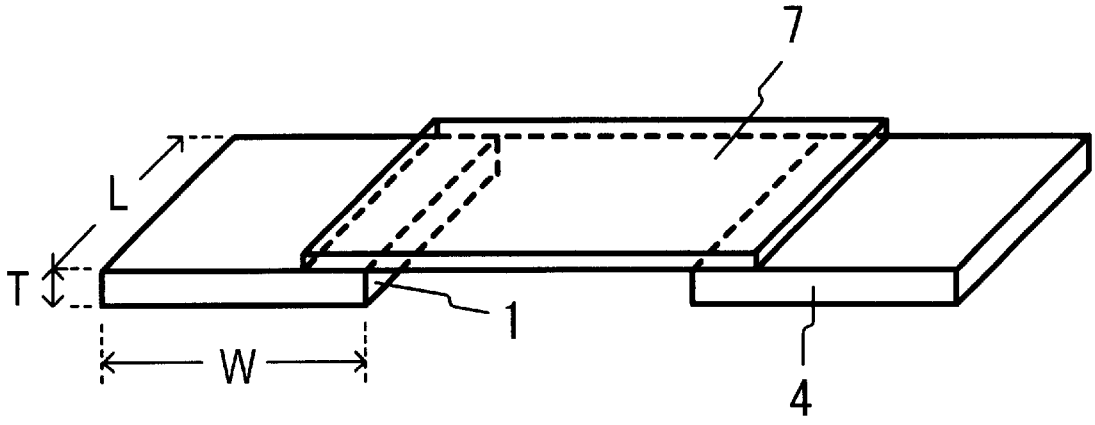
FIG. 1 shows a perspective view of a bridge-type ultrasonic atomizer according to a first embodiment of the present invention.

FIG. 1 shows a perspective view of a bridge-type ultrasonic atomizer according to a first embodiment of the present invention. The ultrasonic atomizer comprises input piezoelectric substrate 1, first electrode 2, second electrode 3, output piezoelectric substrate 4, third electrode 5, fourth electrode 6, porous nonmetalic-plate 7, amplifier 8, and liquid provider 9. First electrode 2, second electrode 3, third electrode 5, fourth electrode 6, amplifier 8 and liquid provider 9 are not drawn in FIG. 1. Each of input piezoelectric substrate 1 and output piezoelectric substrate 4, having an oblong pillar-body, is made of a piezoelectric ceramic with dimensions of 1 mm in thickness (T), 20 mm in length (L), and 17 mm in width (W), and the polarization axis thereof is parallel to the thickness direction thereof. In this time, it is possible to use piezoelectric polymers as input piezoelectric substrate 1 and output piezoelectric substrate 4. Porous nonmetalic-plate 7 is made of a PET plate with an acoustic impedance lower than input piezoelectric substrate 1 and output piezoelectric substrate 4, and formed as a bridge between input piezoelectric substrate 1 and output piezoelectric substrate 4. Porous nonmetalic-plate 7 has many pierced pores, of which each has an outlet with a smaller scale than an inlet. Thus, porous nonmetalic-plate 7 is not only cheap but also harmless for a human body. In this time, it is possible to use another rigid material with a specific gravity smaller than input piezoelectric substrate 1 and output piezoelectric substrate 4, as porous nonmetalic-plate 7. A silicone wafer is also convenient as porous nonmetalic-plate 7.

Figure 2:
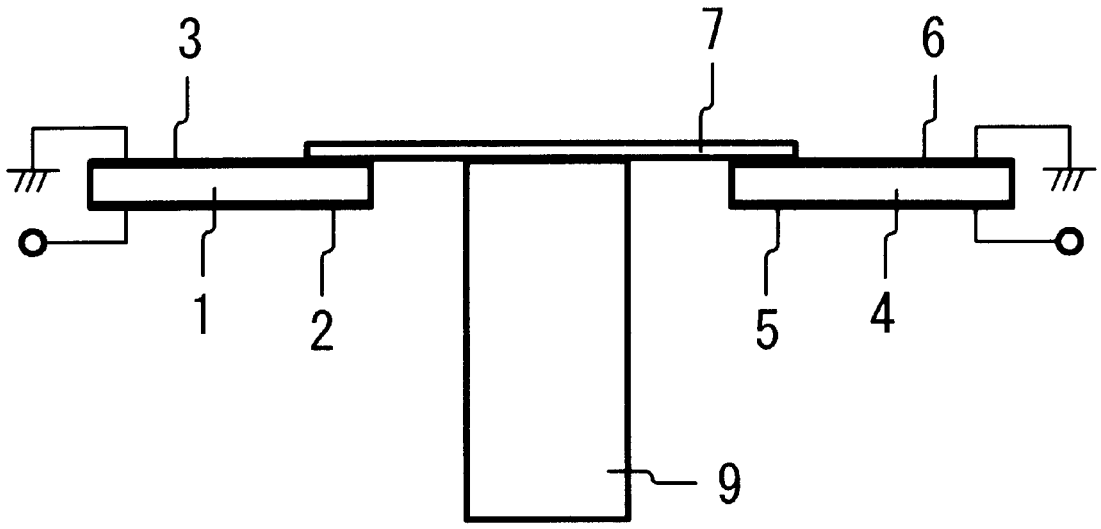
FIG. 2 shows a sectional view of the bridge-type ultrasonic atomizer in FIG. 1.

FIG. 2 shows a sectional view of the bridge-type ultrasonic atomizer in FIG. 1. Amplifier 8 is not drawn in FIG. 2. Liquid provider 9 is made of a liquid-absorption material, which provides porous nonmetalic-plate 7 with a liquid. First electrode 2, second electrode 3, third electrode 5, and fourth electrode 6 are made of an aluminum thin film, respectively. First electrode 2 and second electrode 3 are formed on two end surfaces of input piezoelectric substrate 1, respectively. Third electrode 5 and fourth electrode 6 are formed on two end surfaces of output piezoelectric substrate 4, respectively. Porous nonmetalic-plate 7 is cemented with an edge on second electrode 3 and that on fourth electrode 6.

Figure 3:
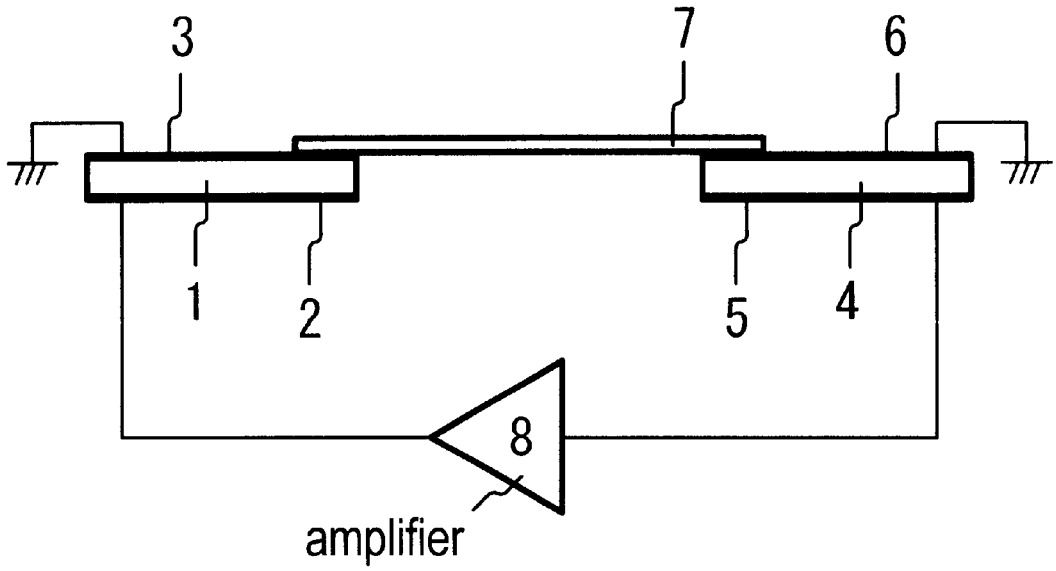
FIG. 3 shows another sectional view of the bridge-type ultrasonic atomizer in FIG. 1.

FIG. 3 shows another sectional view of the bridge-type ultrasonic atomizer in FIG. 1. Liquid provider 9 is not drawn in FIG. 3. When an input electric signal is applied between first electrode 2 and second electrode 3, a first acoustic vibration is excited in input piezoelectric substrate 1. The use of input piezoelectric substrate 1, of which the polarization axis is parallel to the thickness direction thereof, makes the first acoustic vibration to be excited effectively.

There are three types of the resonance frequencies in input piezoelectric substrate 1 alone, that is, the resonance frequencies along the width (W)-, length (L)-, and thickness (T) directions of input piezoelectric substrate 1. In addition, there is the resonance frequency in the combination of input piezoelectric substrate 1 and output piezoelectric substrate 4. The combination of input piezoelectric substrate 1 and output piezoelectric substrate 4 is equivalent to a piezoelectric substrate having a double-sized width (W) or a double-sized length (L) of input piezoelectric substrate 1. Thus, when the input electric signal has a frequency approximately equal to the resonance frequency along either the width (W)- or length (L) direction of input piezoelectric substrate 1, or the resonance frequency along either the width or length direction in the combination of input piezoelectric substrate 1 and output piezoelectric substrate 4, the first acoustic vibration is effectively excited in input piezoelectric substrate 1. In this time, it is ascertained that the resonance frequencies in input piezoelectric substrate 1 alone are approximately equal to those in the combination of input piezoelectric substrate 1 and porous nonmetalic-plate 7. In the same way, it is ascertained that the resonance frequency in the combination of input piezoelectric substrate 1 and output piezoelectric substrate 4 is approximately equal to that in the combination, shown as FIG. 1, composed of three elements, that is, input piezoelectric substrate 1, porous nonmetalic-plate 7, and output piezoelectric substrate 4. In other words, the frequency of the input electric signal is not affected by porous nonmetalic-plate 7. As a result, it is possible to produce standardized articles in the process of manufacturing.

The first acoustic vibration in input piezoelectric substrate 1 propagates in porous nonmetalic-plate 7. In this time, if a liquid is provided into the pierced pores of porous nonmetalic-plate 7 through liquid provider 9, the first acoustic vibration makes the liquid to be atomized from the outlet of porous nonmetalic-plate 7 toward the outside. In a short, the pierced pores of porous nonmetalic-plate 7 make the liquid minute and uniform particles. The first acoustic vibration also causes a second acoustic vibration in output piezoelectric substrate 4. The second acoustic vibration is detected as a delayed electric signal between third electrode 5 and fourth electrode 6. The delayed electric signal is amplified via amplifier 8, and an amplified electric signal is fed as the input electric signal back to first electrode 2 and second electrode 3 again. Thus, a self-oscillation type of atomizer is achieved, so that it is possible to conquer the resonance frequency deviation affected by the temperature change, and then, to provide a continuous-stable atomizer. In addition, it is possible to operate under low voltage with low electric power consumption.

As mentioned above, if a liquid is provided into the pierced pores of porous nonmetalic-plate 7, the liquid is atomized effectively. However, if no liquid is provided into the pierced pores, the first acoustic vibration at porous nonmetalic-plate 7 is scattered, so that the second acoustic vibration does not occur in output piezoelectric substrate 4. As a result, no delayed electric signal causes, so that no input electric signal is applied between first electrode 2 and second electrode 3 again. Thus, porous nonmetalic-plate 7 prevents the operation without liquid.

Figure 4:
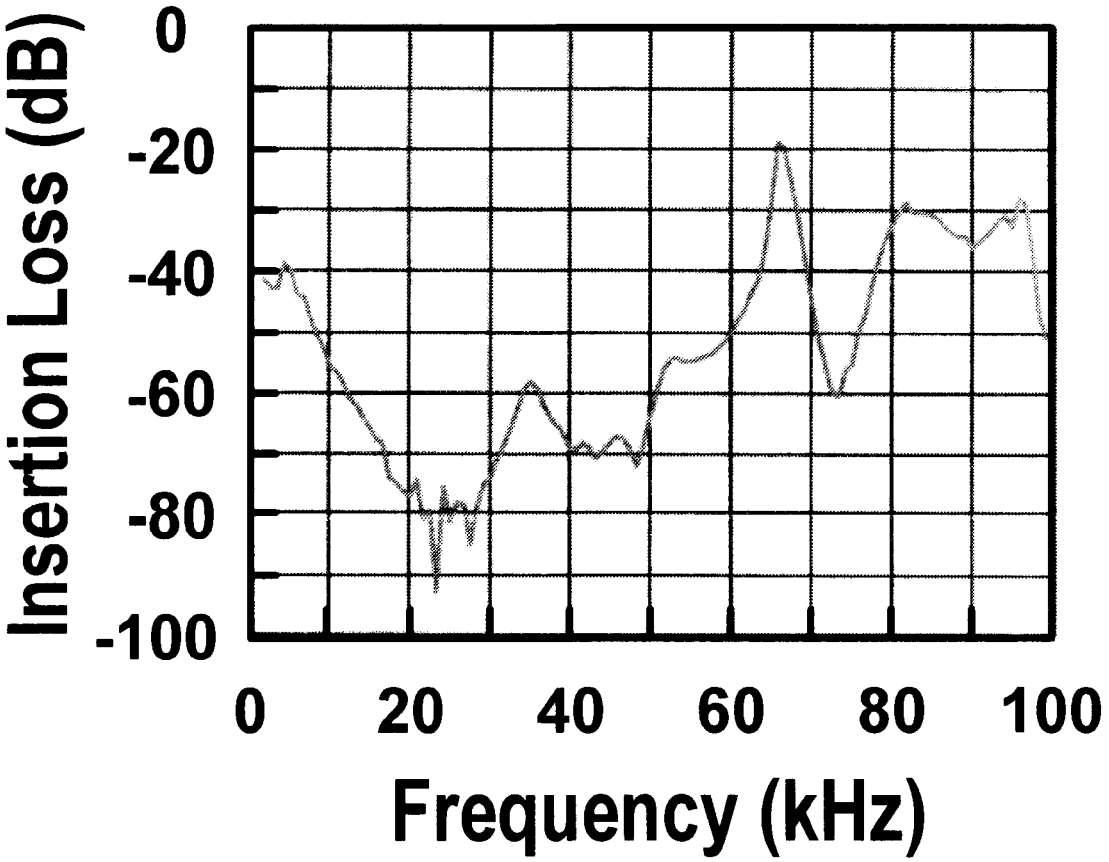
FIG. 4 shows a relationship between the insertion loss and the frequency of the input electric signal.

FIG. 4 shows a relationship between the insertion loss and the frequency of the input electric signal. A peak at approximately 67 kHz corresponds to the resonance frequency along the width direction in the combination of input piezoelectric substrate 1 and output piezoelectric substrate 4. In this time, the combination of input piezoelectric substrate 1 and output piezoelectric substrate 4 is equivalent to a piezoelectric substrate having a double-sized length of input piezoelectric substrate 1.

Figure 5:
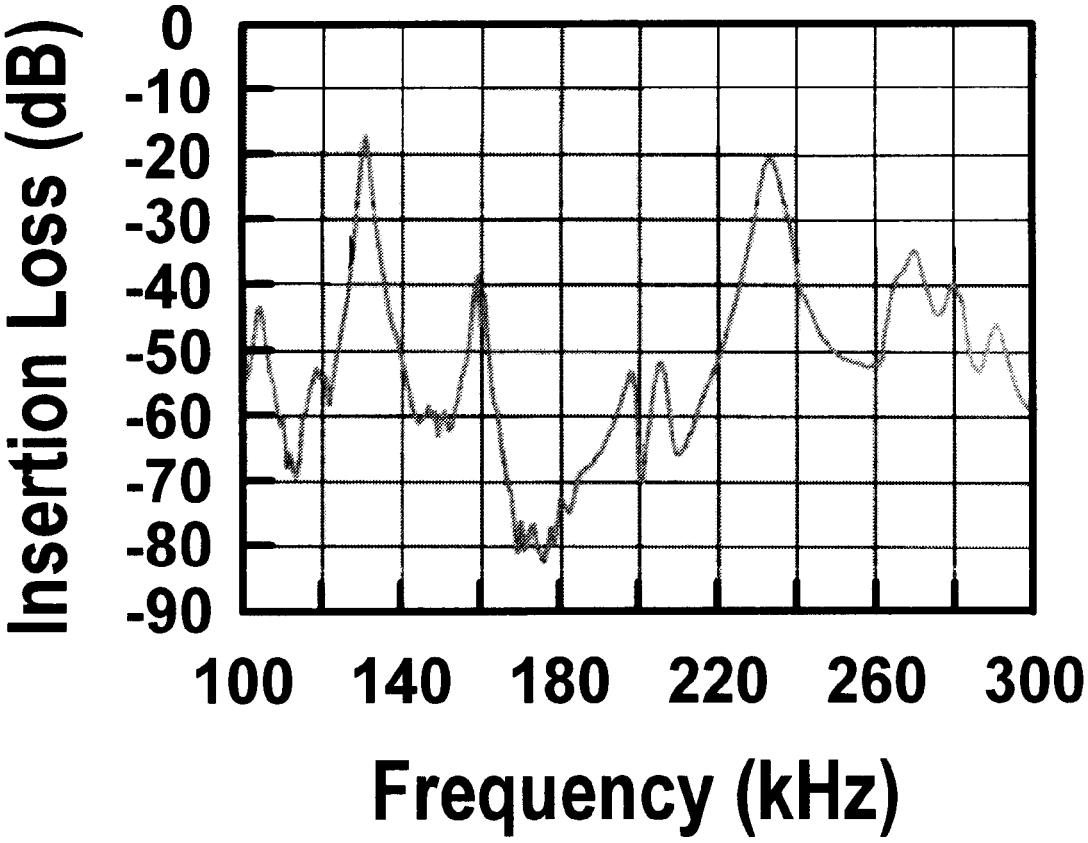
FIG. 5 shows a relationship between the insertion loss and the frequency of the input electric signal.

FIG. 5 shows a relationship between the insertion loss and the frequency of the input electric signal. Two peaks at approximately 105- and 233 kHz correspond to first- and second resonance frequencies along the length (L) direction of input piezoelectric substrate 1. Two peaks at approximately 130- and 268 kHz correspond to first- and second resonance frequencies along the width (W) direction of input piezoelectric substrate 1.

Figure 6:
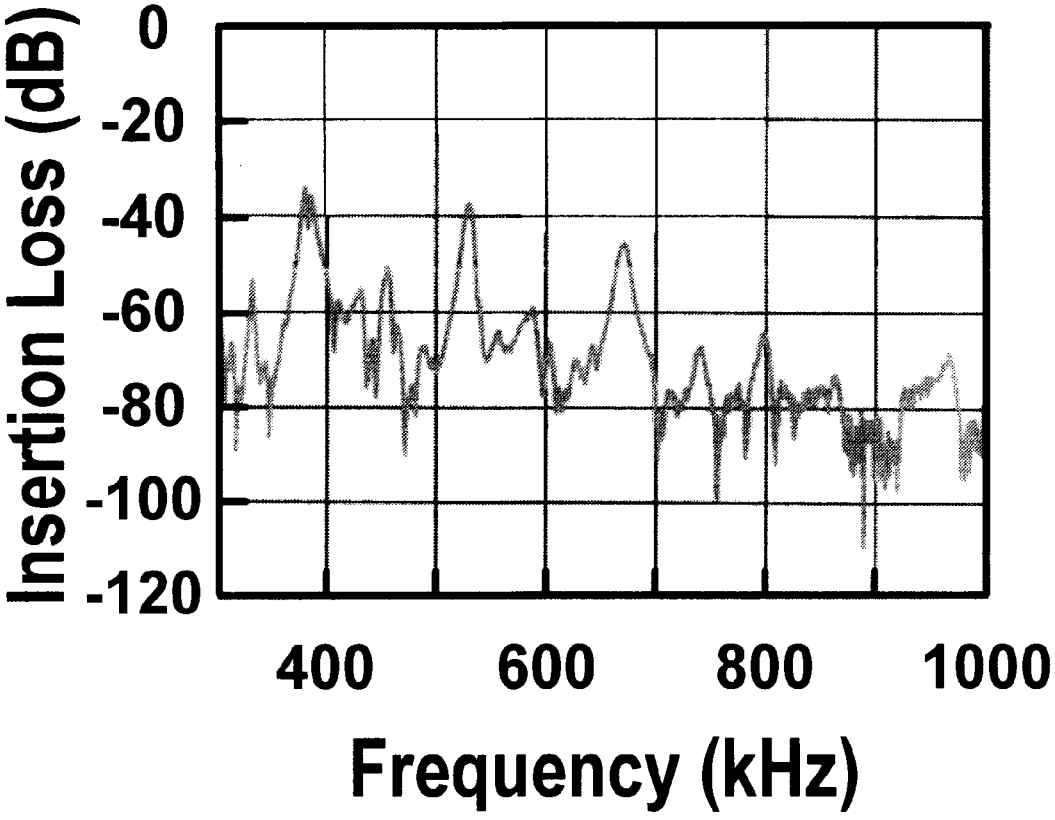
FIG. 6 shows a relationship between the insertion loss and the frequency of the input electric signal.

FIG. 6 shows a relationship between the insertion loss and the frequency of the input electric signal. A peak at approximately 380 kHz corresponds to a third resonance frequency along the width (W) direction of input piezoelectric substrate 1. A peak at approximately 675 kHz corresponds to a third resonance frequency along the length (L) direction of input piezoelectric substrate 1.

It should be noticed from FIGS. 4–6 that the first acoustic vibration is effectively excited in input piezoelectric substrate 1 when the input electric signal has the frequency approximately equal to the resonance frequency at each peak.

Figure 7:
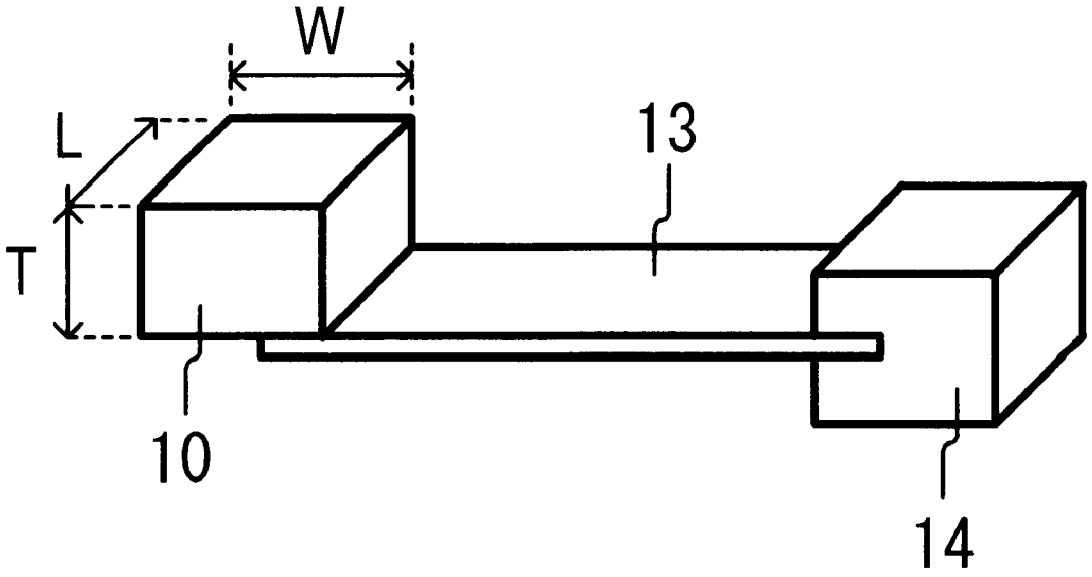
FIG. 7 shows a perspective view of a bridge-type ultrasonic atomizer according to a second embodiment of the present invention.

FIG. 7 shows a perspective view of a bridge-type ultrasonic atomizer according to a second embodiment of the present invention. The ultrasonic atomizer comprises piezoelectric substrate 10, first electrode 11, second electrode 12, porous nonmetalic-plate 13, vibration reflector 14, and liquid provider 9. First electrode 11, second electrode 12, and liquid provider 9 are not drawn in FIG. 7. Piezoelectric substrate 10 is made of the same material as input piezoelectric substrate 1, and has an oblong pillar-body with dimensions of 4 mm in thickness (T), 5 mm in length (L), and 5 mm in width (W). In other words, piezoelectric substrate 10 has two end surfaces, orthogonal to the thickness direction thereof, with a square shape, respectively. Porous nonmetalic-plate 13 is made of the same material as porous nonmetalic-plate 7, and formed as a bridge between piezoelectric substrate 10 and vibration reflector 14, which acts as a supporter for porous nonmetalic-plate 13. Vibration reflector 14 is made of a silicone wafer, and has an acoustic impedance higher than porous nonmetalic-plate 13.

Figure 8:
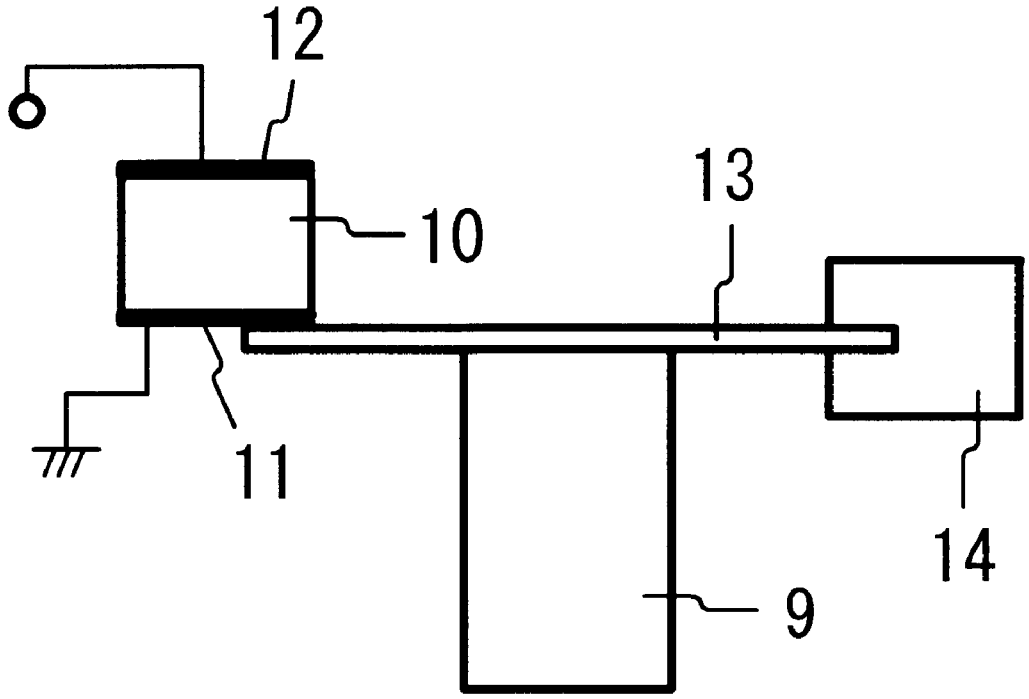
FIG. 8 shows a sectional view of the bridge-type ultrasonic atomizer in FIG. 7.

FIG. 8 shows a sectional view of the bridge-type ultrasonic atomizer in FIG. 7. Liquid provider 9 provides porous nonmetalic-plate 13 with a liquid. First electrode 11 and second electrode 12, made of an aluminum thin film, respectively, are formed on two end surfaces of piezoelectric substrate 10, respectively. Porous nonmetalic-plate 13 is cemented with an edge under first electrode 11 and a gap in vibration reflector 14. When an input electric signal is applied between first electrode 11 and second electrode 12, an acoustic vibration is excited in piezoelectric substrate 10. The acoustic vibration propagates in porous nonmetalic-plate 13. In this time, if a liquid is provided into pierced pores of porous nonmetalic-plate 13 through liquid provider 9, the acoustic vibration makes the liquid to be atomized from the outlet of porous nonmetalic-plate 13 toward the outside. On the other hand, the acoustic vibration is reflected at vibration reflector 14 back to porous nonmetalic-plate 13. Thus, energy loss is suppressed.

Figure 9:
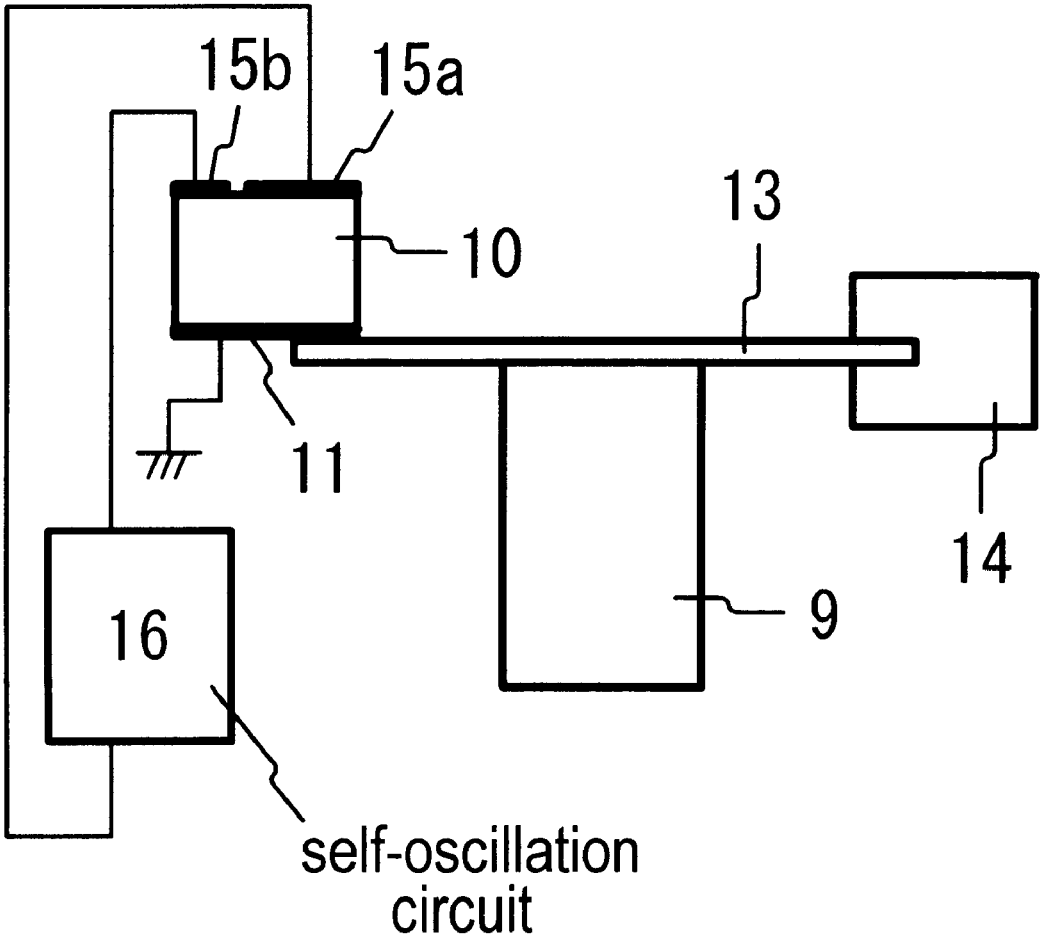
FIG. 9 shows a sectional view of a bridge-type ultrasonic atomizer according to a third embodiment of the present invention.

FIG. 9 shows a sectional view of a bridge-type ultrasonic atomizer according to a third embodiment of the present invention. The ultrasonic atomizer has the same construction as FIG. 8 except for the presence of self-oscillation circuit 16, and the use of two electrically separated electrodes, 15*a* and 15*b*, in place of second electrode 12. When an input electric signal is applied between first electrode 11 and electrode 15*a*, an acoustic vibration is excited in piezoelectric substrate 10. The acoustic vibration propagates in porous nonmetalic-plate 13. In this time, if a liquid is provided into pierced pores of porous nonmetalic-plate 13 through liquid provider 9, the acoustic vibration makes the liquid to be atomized from the outlet of porous nonmetalic-plate 13 toward the outside. On the other hand, the acoustic vibration is reflected at vibration reflector 14 back to porous nonmetalic-plate 13. Thus, energy loss is suppressed. The acoustic vibration in piezoelectric substrate 10 also causes a delayed electric signal between first electrode 11 and electrode 15*b*. The delayed electric signal is fed as the input electric signal via oscillation circuit 16 back to first electrode 11 and electrode 15*a* again. Thus, a self-oscillation type of atomizer is achieved.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A bridge-type ultrasonic atomizer comprising:

an input piezoelectric substrate with a pillar body having two end surfaces orthogonal to the thickness direction thereof;

a first electrode formed on one end surface of said input piezoelectric substrate;

a second electrode formed on the other end surface of said input piezoelectric substrate;

an output piezoelectric substrate with the same shape as said input piezoelectric substrate;

a third electrode formed on one end surface of said output piezoelectric substrate;

a fourth electrode formed on the other end surface of said output piezoelectric substrate;

a porous nonmetalic-plate formed as a bridge between said input- and output piezoelectric substrates; and an amplifier, said first- and second electrodes receiving an input electric signal, and causing a first acoustic vibration in said input piezoelectric substrate, said porous nonmetalic-plate receiving said first acoustic vibration, and atomizing a liquid in pierced pores of said porous nonmetalic-plate, and at the same time, generating a second acoustic vibration in said output piezoelectric substrate only when said liquid exists in said pierced pores of said porous nonmetalic-plate, said third- and fourth electrodes detecting said second acoustic vibration as a delayed electric signal, said amplifier amplifying said delayed electric signal and feeding an amplified electric signal as said input electric signal back to said first- and second electrodes again.

2. A bridge-type ultrasonic atomizer as defined in claim 1, wherein said input electric signal has a frequency approximately equal to the resonance frequency in the combination of said input- and output piezoelectric substrates.

3. A bridge-type ultrasonic atomizer as defined in claim 1, wherein said input electric signal has a frequency approximately equal to the resonance frequency in said input piezoelectric substrate alone.

4. A bridge-type ultrasonic atomizer as defined in claim 1, wherein said porous nonmetalic-plate has a specific gravity smaller than said input- and output piezoelectric substrates, respectively.

5. A bridge-type ultrasonic atomizer as defined in claim 1, wherein said porous nonmetalic-plate is made of a rigid polymer plate.

6. A bridge-type ultrasonic atomizer as defined in claim 1, wherein said porous nonmetalic-plate is made of a silicone wafer.

7. A bridge-type ultrasonic atomizer as defined in claim 1, wherein each of said two end surfaces of said input piezoelectric substrate has an oblong shape, and said porous nonmetalic-plate is cemented with an edge on said second electrode and that on said fourth electrode.

8. A bridge-type ultrasonic atomizer as defined in claim 1, wherein each of said two end surfaces of said input piezoelectric substrate has a square shape, and said porous nonmetalic-plate is cemented with an edge on said second electrode and that on said fourth electrode.

9. A bridge-type ultrasonic atomizer as defined in claim 1, wherein each of said input- and output piezoelectric substrates is made of a piezoelectric ceramic, of which the polarization axis is parallel to the thickness direction thereof.

10. A bridge-type ultrasonic atomizer as defined in claim 1 further comprising a liquid provider with a liquid-absorption material, which provides said porous nonmetalic-plate with said liquid.

11. A bridge-type ultrasonic atomizer comprising:

a piezoelectric substrate with a pillar body having two end surfaces orthogonal to the thickness direction thereof;

a first electrode formed on one end surface of said piezoelectric substrate;

a second electrode formed on the other end surface of said piezoelectric substrate;

a vibration reflector;

a porous nonmetalic-plate formed as a bridge between said piezoelectric substrate and said vibration reflector, said first- and second electrodes receiving an input electric signal, and causing an acoustic vibration in said piezoelectric substrate, said porous nonmetalic-plate receiving said acoustic vibration, and atomizing a liquid in pierced pores of said porous nonmetalic-plate, said vibration reflector reflecting said acoustic vibration back to said porous nonmetalic-plate.

12. A bridge-type ultrasonic atomizer as defined in claim 11, wherein said input electric signal has a frequency approximately equal to the resonance frequency in said piezoelectric substrate alone.

13. A bridge-type ultrasonic atomizer as defined in claim 11, wherein said porous nonmetalic-plate has a specific gravity smaller than said piezoelectric substrate.

14. A bridge-type ultrasonic atomizer as defined in claim 11, wherein said porous nonmetalic-plate is made of a rigid polymer plate.

15. A bridge-type ultrasonic atomizer as defined in claim 11, wherein said porous nonmetalic-plate is made of a silicone wafer.

16. A bridge-type ultrasonic atomizer as defined in claim 11, wherein said piezoelectric substrate is made of a piezoelectric ceramic, of which the polarization axis is parallel to the thickness direction thereof.

17. A bridge-type ultrasonic atomizer as defined in claim 11, wherein said piezoelectric substrate is made of a piezoelectric polymer.

18. A bridge-type ultrasonic atomizer as defined in claim 11, wherein each of said two end surfaces of said piezoelectric substrate has an oblong shape.

19. A bridge-type ultrasonic atomizer as defined in claim 11, wherein each of said two end surfaces of said input piezoelectric substrate has a square shape.

20. A bridge-type ultrasonic atomizer comprising:

a piezoelectric substrate with a pillar body having two end surfaces orthogonal to the thickness direction thereof;

a first electrode formed on one end surface of said piezoelectric substrate;

a second electrode consisting of two electrically separated electrodes, and formed on the other end surface of said piezoelectric substrate;

a vibration reflector;

a porous nonmetalic-plate formed as a bridge between said piezoelectric substrate and said vibration reflector, said first electrode and one of said electrically separated electrodes receiving an input electric signal, and causing an acoustic vibration in said piezoelectric substrate, said porous nonmetalic-plate receiving said acoustic vibration, and atomizing a liquid in pierced pores of said porous nonmetalic-plate, said vibration reflector reflecting said acoustic vibration back to said porous nonmetalic-plate, said first electrode and the other of said electrically separated electrodes receiving said acoustic vibration as a delayed electric signal, and feeding said delayed electric signal as said input electric signal back to said first electrode and said one of said electrically separated electrodes again.

* * * * *